United States Patent [19]

Cousin

[11] Patent Number: 4,652,228

[45] Date of Patent: Mar. 24, 1987

[54] MOLDING MACHINE WITH VIBRATION SYSTEM

[75] Inventor: Philippe Cousin, St Calixte, Canada

[73] Assignee: Proneq Industries Inc., St. Calixte, Canada

[21] Appl. No.: 823,007

[22] Filed: Jan. 27, 1986

[51] Int. Cl.[4] ..... B28B 1/08

[52] U.S. Cl. ..... 425/432; 264/71; 425/421; 425/424; 425/452; 425/456

[58] Field of Search ..... 425/421, 424, 432, 452, 425/456, 150, 163, DIG. 117; 264/71

[56] References Cited

U.S. PATENT DOCUMENTS

| | | | |
|---|---|---|---|
| 1,453,746 | 5/1923 | Carey | 264/71 |
| 1,905,975 | 4/1933 | Thomas | 425/452 X |
| 2,526,198 | 10/1950 | Clanton | 425/424 |
| 2,670,516 | 3/1954 | McEachran | 425/421 |
| 2,692,418 | 10/1954 | Besser | 425/424 X |
| 2,835,016 | 5/1958 | Dixon, Jr. | 425/424 X |
| 3,128,522 | 4/1964 | Benjey et al. | 425/424 |
| 3,143,780 | 8/1964 | Clanton et al. | 425/452 |
| 3,277,551 | 10/1966 | Sekiguchi | 425/421 X |
| 3,310,854 | 3/1967 | Zevely | 425/421 X |
| 3,426,403 | 2/1969 | Wochner | 425/424 X |
| 3,679,340 | 7/1972 | Springs | 425/163 |
| 3,806,297 | 4/1974 | Scales | 425/421 X |
| 4,238,177 | 12/1980 | Crile et al. | 425/150 |

*Primary Examiner*—Richard L. Chiesa
*Attorney, Agent, or Firm*—Robic, Robic & Associates

[57] ABSTRACT

A molding machine is disclosed which includes a vibration zone; an endless conveyor movable across the vibration zone and having tread plates pivotally connected in succession. The molds are provided on the tread plates and include bottom wall pallets each freely supported by one of the tread plates. Upward vibration is applied to the bottom wall pallets independently of the tread plates as the conveyor moves across the vibration zone.

9 Claims, 5 Drawing Figures

MOLDING MACHINE WITH VIBRATION SYSTEM

BACKGROUND OF THE INVENTION

1. Field of the invention

The present invention relates to a molding machine and, more particularly, to an improved automatic concrete brick-making machine.

2. Description of the related art

In a known machine of this type, the brick molds are defined, in part, by tread plates of an endless conveyor that are pivotally interconnected in succession. Pallets that serve to remove the bricks, once molded, act as bottom walls for the brick molds and are freely supported by the tread plates. The machine includes a hopper section where concrete mix is fed into the molds, followed by a tamper section where the concrete mix is compacted and further followed by a trowel section to provide the bricks with a smooth surface finish.

As with any concrete mix, vibration of the concrete mass is necessary to obtain homogenous mixture of the concrete components and to ensure the production of void-free concrete bricks. As of now, this vibration is obtained by applying a rapid back and forth movement to either the tamper head or by applying the vibration movement directly to the tread plates of the conveyor. In both cases, however, vibration being applied as it is to major parts of the machine, this has led to frequent and costly mechanical breakdowns.

SUMMARY OF THE INVENTION

An object of the invention therefore lies in overcoming the above difficulties and this is achieved by vibrating the aforesaid pallets that act also as bottom walls for the molds, the vibration taking place completely independently of the other moving parts of the machine, thus providing an absolutely trouble-free operation having regard to the vibration movement.

More specifically, the invention is a molding machine having a vibration zone across which an endless conveyor moves, this conveyor having a plurality of tread plates pivotally connected in succession. Mold wall means are provided over each of the tread plates, the mold wall means including bottom wall pallets wherein each pallet is freely supported by one of the tread plates. Means are provided for vibrating the bottom wall pallets in upward direction independently of the tread plates when the conveyor moves across the vibration zone.

According to a preferred embodiment, the vibration means comprise a vibration frame, in the vibration zone, this frame including support means carrying the bottom wall pallets independently of the tread plates as the said tread plates as well as the bottom wall pallets move across the vibration zone; means being further provided to vibrate the vibration frame upwardly thereby vibrating the bottom wall pallets independently of the tread plates.

Advantageously, the bottom wall pallets have terminal portions projecting from the ends of the tread plates, laterally of the conveyor, and the support means of the vibration frame comprise upright lateral pallet supports, laterally of the conveyor, these lateral supports defining upper edges over which the pallet terminal portions are applied when the conveyor moves across the vibration zone.

Where the tread plates are long enough, crosswise of the conveyor, and serve to define several brick molds, central props for the pallets may be necessary. Such props may be obtained by upright intermediate supports freely extending through the tread plates; these supports having upper pads applied against the bottom of the tread plates and lower pads riding on shoe-carrying bars of the vibration frame.

BRIEF DESCRIPTION OF THE DRAWING

A description of a preferred embodiment of the invention now follows having reference to the appended drawing wherein.

DESCRIPTION OF THE PREFERRED EMBODIMENT

Figure 1:
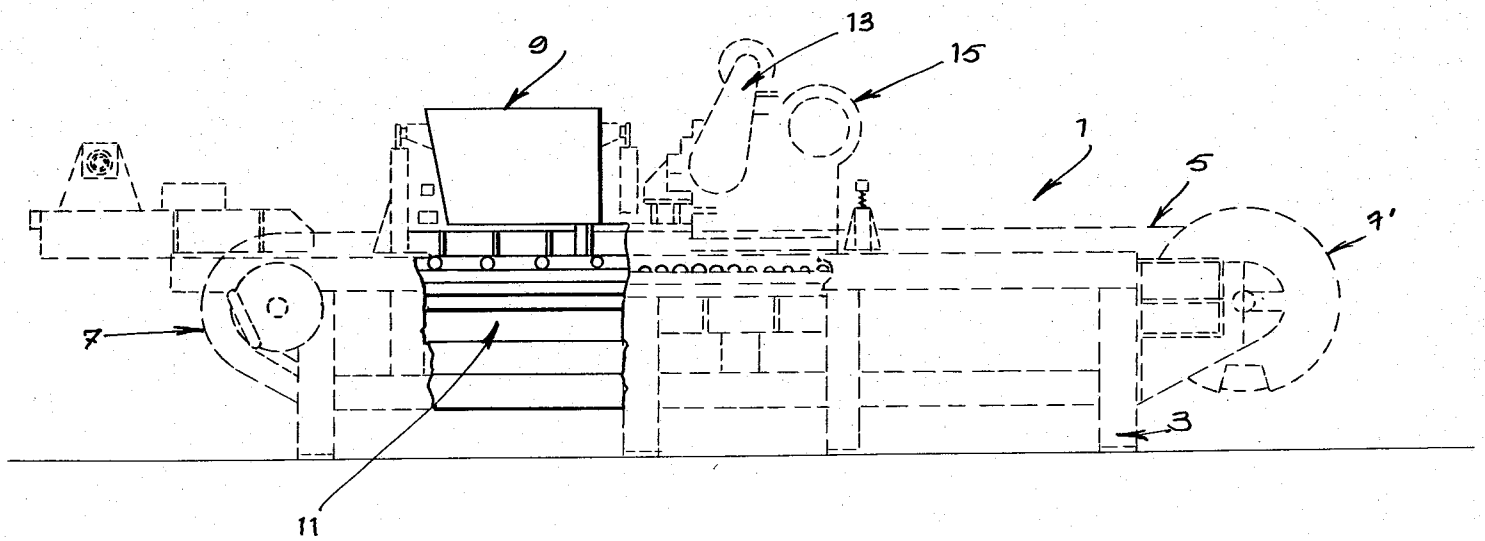
FIG. 1 is a side elevation view of a concrete brick-making machine to which the vibration system of the invention has been applied.

FIG. 1 illustrates a concrete brick-making machine 1 having an upright frame 3 on which is mounted a chain conveyor 5 winding around terminal sprocket wheels 7, 7'. The concrete mix is fed in the brick molds of the conveyor 5 from the hopper 9 standing over the vibration zone 11 to be more fully described hereinafter. The vibration zone is followed by a tamper section 13 where the concrete mix is compacted and further followed by a trowel section 15 providing the bricks with the required smooth surface finish. Pallets, to be further described hereinafter, are removed from the conveyor at the end of the machine comprising the sprocket wheels 7'.

The chain conveyor 5 has a plurality of tread plates 17 pivotally interconnected in succession by shaft arrangements 19 drawn by chains 21 winding around the sprocket wheels 7, 7'.

The tread plates are wide enough to provide for the making of several brick molds. Pallets 23, each freely supported by one of the tread plates 17, serve as bottom walls for all of the molds corresponding to one tread plate as perhaps best illustrated in FIG. 2. The tread plates are provided with upwardly projecting conical prongs 25 that serve to define bores through the bricks, the pallets 23 themselves being formed with round apertures 27 through which the prongs 25 extend. As said previously, vibration means are provided for upwardly vibrating the bottom wall pallets independently of the tread plates 17 when the conveyor 5 moves through the vibration zone 11.

Figure 2:
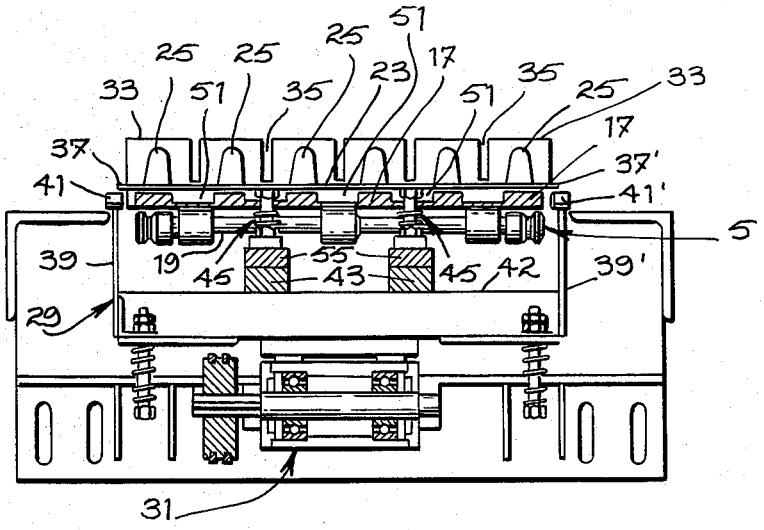
FIG. 2 is a transverse cross-sectional view through the vibration zone of the machine.

Such vibration means essentially comprise a vibration frame 29, providing support for the pallets 23 of the successive tread plates 17, and means 31 to vibrate the frame 29, both being clearly identified in FIG. 2 and provided in the vibration zone 11. Since the pallets 23 are merely supported by the tread plates 17, they may be vibrated easily without the tread plates 17 being affected.

Figure 3:
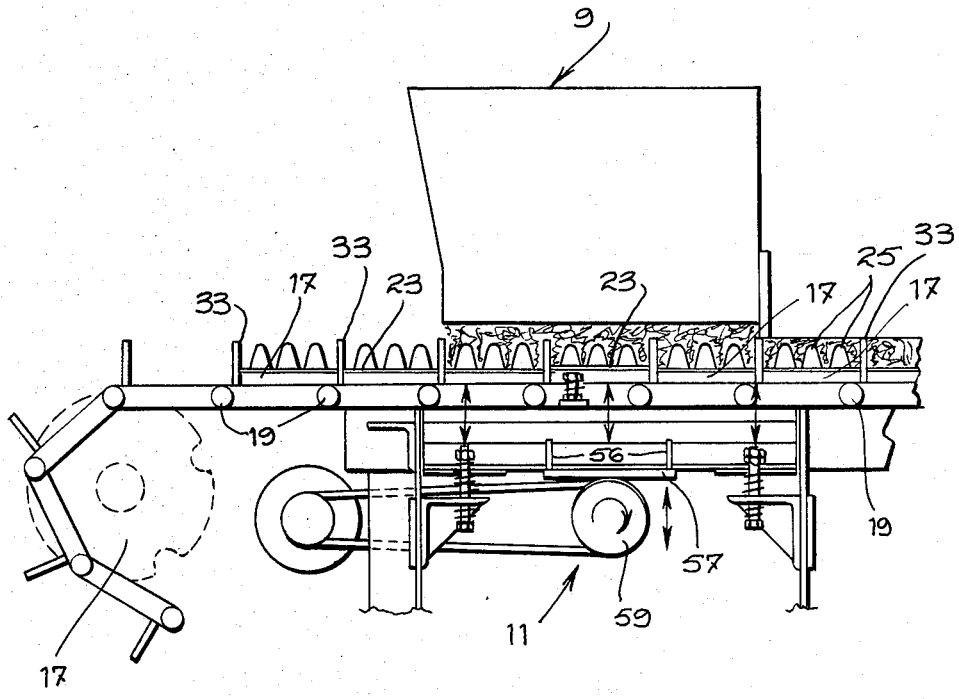
FIG. 3 is a longitudinal cross-sectional view through the vibration zone.

As said previously, the pallets 23 serve as bottom walls for the brick molds, the end walls of the molds being provided by a pair of upright rigid plates 33 (FIGS. 2 and 3) secured along the lateral edges of the tread plates 17. The rigid plates 33 are cut to form vertical slots 35 intended to receive lengthwise plates (not shown) serving to define the side walls of the molds and depending from the hopper 9.

Referring to FIG. 2, it will be seen that the bottom wall pallets 23 have terminal portions 37, 37' that project from the ends of the corresponding tread plates, laterally of the conveyor 5. The vibration frame 29 is formed with upright lateral pallet supports 39, 39', terminating into edge pads 41, 41' over which the pallet terminal portions 37, 37', are applied when the conveyor moves across the vibration zone 11.

The pallet supports 39, 39', of the vibration frame 29 are rigidly interconnected, at their base, by square-forming frame members 42 (FIG. 5) and a pair of shoe-carrying bars 43 are also secured at the base of the lateral pallet supports 39, 39', extending in the direction of movement of the conveyor 5.

A pair of intermediate pallet supports 45, each corresponding to one of the two shoe-carrying bars, are also provided and are useful particularly where the pallets 23 are particularly long and serve to prevent sagging of the pallets.

Figure 5:
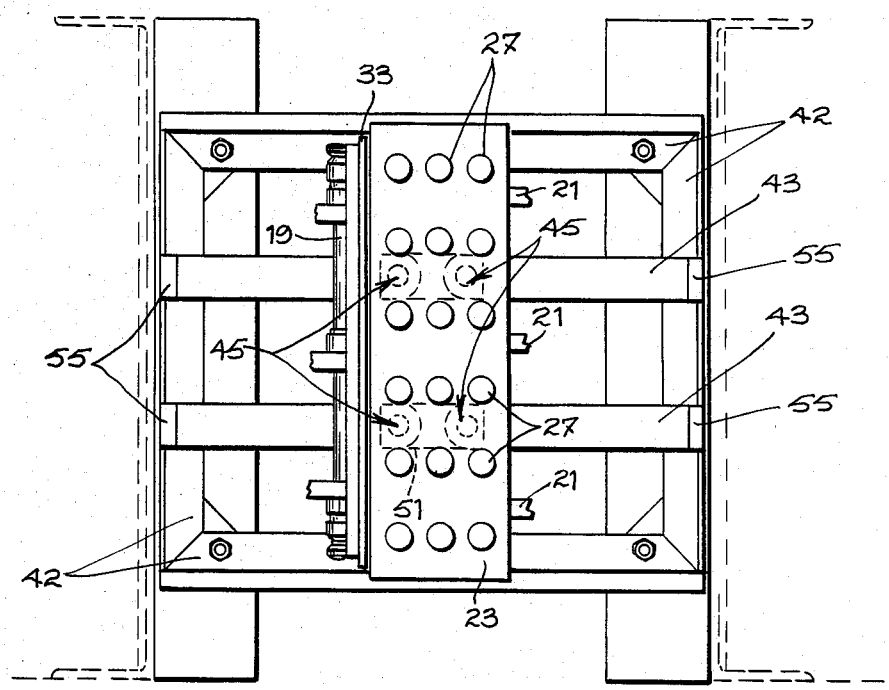
FIG. 5 is a top plan view, of part of the machine in the vibration zone,immediately above the conveyor.
Figure 4:
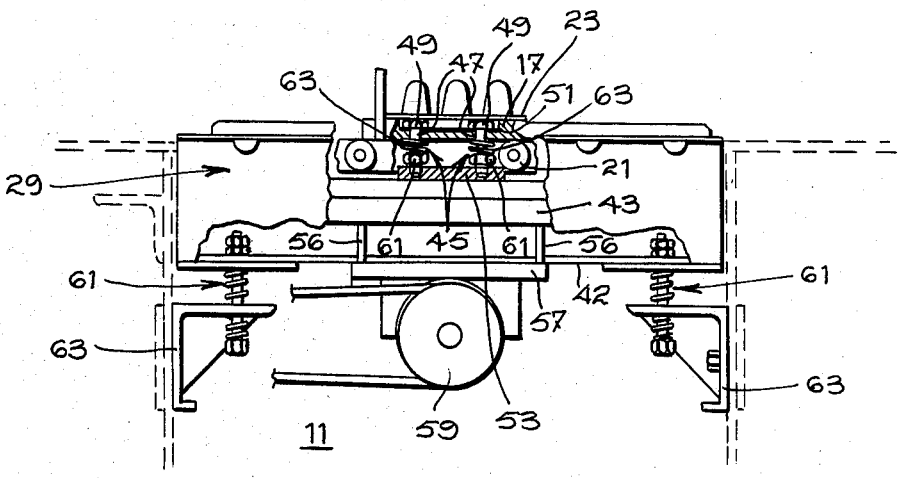
FIG. 4 is a view similar to FIG. 3 but on a larger scale.

As perhaps best illustrated in FIG. 4, each such intermediate pallet support 45 comprises a bolt of which the stem 47 freely extends through the corresponding tread plate 17 and of which the head 49 is housed into an appropriate recess 51 formed on the top of the tread plate 17 in such a manner that the top surface of the head 49 lies beneath and against the corresponding pallet 23. As shown in FIGS. 4 and 5, the intermediate pallet supports 45 are arranged in pairs and the bolt heads 49 act as support pads. The bolt stems of one pair of pallet supports 45 are screwed into a lower shoe 53 which rides on the top surface of the shoe-carrying bars 43. The latter may appropriately be rounded at their ends, as at 55 in FIG. 5, to assist in bringing the shoes 53 over the bars 43.

FIG. 4 illustrates that the shoe-carrying bars 43 are supported by and fixed to transverse braces 56 which are secured, in turn, to the lateral frame members 42. A transverse vibration plate 57 is secured to the lower edge of the transverse braces 56 as well as to the lateral frame members 42. The transverse vibration plate 57 rests on an eccentric shaft 59 brought into rotation by any known means.

There will thus be seen that the shoe-carrying bars 43, the transverse braces 56, the transverse vibration plate 57 and the lateral frame members 42 are all solidly interconnected and integrated to the vibration frame 29. Thus, as the eccentric shaft 59 rotates, the said frame 29 vibrates, causing vibration of the pallets 23 through the intermediate pallet supports 45. The same movement is of course applied, as aforesaid, to the terminal portions 37, 37', of the pallets by the edge pads 41, 41'.

The bolt stems 47 are also provided, at their lower ends and above the shoes 53 with nuts 61 and springs 63 are provided between the said nuts 61 and the bottom surface of the tread plate 17. This arrangement will of course ensure proper return of the bolt heads 49 at the bottom of the recesses 51.

Similarly, appropriate spring arrangements 61, between the vibration frame 29 and the machine frame 63, ensure resilient application of the transverse vibration plate 57 against the eccentric shaft 59. These spring arrangements 61 are quite conventional and need not be described further.

It will thus be appreciated that rotation of the eccentric shaft 59 will cause vibration of the frame 29 and, consequently, vibration of the pallet 23 completely independently of the tread plate 17, which was precisely what was intended.

I claim:

1. A molding mahine including, in combination:

a vibration zone;

an endless conveyor movable across said virbration zone, said conveyor having a plurality of tread plates pivotally connected in succession;

mold wall means, over each of said tread plates, said mold wall means including bottom wall pallets, each of said pallets being freely supported by one of said tread plates; and means for vibrating said bottom wall pallets in vertical direction independently of said tread plates, when said conveyor moves across said vibration zone, said vibrating means comprising a vibration frame, in said zone, said frame including support means supporting said bottom wall pallets independently of said tread plates, as said tread plates and bottom wall pallets move across said vibration zone, and means vibrating said vibration frame upwardly thereby vibrating said bottom wall pallets independently of said tread plates, wherein said bottom wall pallets have terminal portions projecting from the ends of said tread plates, laterally of said conveyor, and said support means of said vibration frame comprise upright lateral pallet supports laterally of said conveyor, said lateral supports defining upper edge pads over which said pallet terminal portions are applied when said conveyor moves through said vibration zone whereby said pallets are vibrated independently of said tread plates when in said zone.

2. A machine as claimed in claim 1, wherein said support means of said vibration frame further comprise: at least one pair of spaced shoe-carrying bars extending in the direction of movement of said conveyor, said combination further comprising: upright intermediate pallet supports freely extending through said tread plates, said intermediate supports including upper pads applied to and against said bottom wall pallets and including lower shoes riding on said shoe-carrying bars.

3. A machine as claimed in claim 2, wherein said tread plates comprise upwardly projecting boredefining prongs and said bottom wall pallets are formed with apertures through which said prongs extend.

4. A machine as claimed in claim 2, including means interconnecting said shoe-carrying bars centrally of said bars, and wherein said vibrating means comprise an eccentric wheel applied against said interconnecting means for vibrating said vibration frame.

5. A machine as claimed in claim 2, wherein said tread plates are formed with recesses into which said intermediate support pads are nested, and further comprising means resiliently holding said pads in said recesses.

6. A machine as claimed in claim 1, wherein said support means of said vibration frame further comprise: at least one shoe-carrying bar, said bar extending in the direction of movement of said conveyor, said combination further comprising: at least one upright intermediate pallet support for each of said tread plates and mounted thereon for freely extending through said tread plates, said intermediate supports including upper pads applied to and against said bottom wall pallets and including lower shoes riding on said shoe-carrying bar.

7. A machine as claimed in claim 6, wherein said tread plates comprise upwardly projecting bore-defining prongs and said bottom wall pallets are formed with apertures through which said prongs extend.

8. A machine as claimed in claim 6, including means beneath said shoe-carrying bar centrally of said bars, and wherein said vibrating means comprise an eccentric wheel applied against said interconnecting means for vibrating said vibration frame.

9. A machine as claimed in claim 6, wherein said tread plates are formed with recesses into which said intermediate support pads are nested, and further comprising means resiliently holding said pads in said recesses.

* * * * *